US006632988B1

(12) United States Patent
Jones et al.

(10) Patent No.: US 6,632,988 B1
(45) **Date of Patent: *Oct. 14, 2003**

(54) DAMPER ADJUSTMENT DEVICE

(75) Inventors: M. Scott Jones, Port Washington, NY (US); Maik Jenfeldt, Hamburg (DE)

(73) Assignee: Steinway Musical Instruments, Inc., Waltham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/542,528

(22) Filed: Apr. 4, 2000

(51) Int. Cl.[7] ..... G10C 3/00
(52) U.S. Cl. ..... 84/216; 84/217; 84/218
(58) Field of Search ..... 84/13, 216, 217, 84/218

(56) References Cited

U.S. PATENT DOCUMENTS

| | | | | |
|---|---|---|---|---|
| 4,161,129 A | | 7/1979 | Carbone | 84/253 |
| 4,450,747 A | | 5/1984 | Aoyama | 84/220 |
| 4,685,371 A | * | 8/1987 | Levinson | 84/239 |
| 5,022,302 A | | 6/1991 | Guyon | 84/255 |
| 5,932,820 A | | 8/1999 | Kihara | 84/216 |
| 5,936,172 A | * | 8/1999 | De La Rochefordiere | 84/217 |
| 6,020,544 A | * | 2/2000 | Jones et al. | 84/218 |
| 6,194,643 B1 | * | 2/2001 | Meisel | 84/18 |

FOREIGN PATENT DOCUMENTS

| | | |
|---|---|---|
| DE | 197 03 445 A1 | 8/1998 |
| JP | 54 058428 A | 5/1979 |

* cited by examiner

*Primary Examiner*—Kimberly Lockett
(74) *Attorney, Agent, or Firm*—Fish & Richardson P.C.

(57) ABSTRACT

A damper assembly for a piano includes a rail assembly with an adjustable mount for mounting the rail assembly to the piano case, and a plurality of underlevers coupled to the rail assembly. The rail assembly is configured for vertical adjustment relative to the case, for example, continuous adjustment (in which the rail assembly can define a vertical slot) or discrete adjustment (in which the rail assembly defines discrete openings arranged vertically). The adjustable mount includes mounting blocks, and the rail is mounted to the blocks for rotation relative to the blocks. The mounting blocks each define an adjustment slot. A method of simultaneously adjusting a plurality of piano underlevers in a piano includes mounting a damper assembly to a piano case with an adjustable mount, and adjusting the position of a rail assembly of the damper assembly relative to the case.

25 Claims, 13 Drawing Sheets

DAMPER ADJUSTMENT DEVICE

BACKGROUND OF THE INVENTION

The invention relates to a damper adjustment device for pianos, and in particular to the damper timing in grand and upright pianos.

An acoustic piano, by way of a keyboard and hammer mechanism (action), excites tensioned strings to produce tones. The strings are dampened by a second mechanism, the damper assembly. The "feel" of the piano action, that is, the real and perceived heaviness of the piano keys, depends on the damper timing—the point in the piano keystroke at which the damper is removed from the string. If the dampers are displaced from the strings early in the piano keystroke, it takes more force to depress the keys, making the keys "feel heavy". On the other hand, if the dampers are displaced later in the keystroke, the keys feel "livelier" to the pianist. Personal preferences can dictate the exact timing desired.

Referring to FIGS. 1 and 2, a prior art damper assembly 100 of a typical grand piano includes cushions 1 mounted on a damper head 2, which is typically held above a piano string 30 as shown. When cushions 1 are in contact with string 30, cushions 1 dampen vibrations of string 30. Cushions 1 are typically made of felt or another material which can absorb vibration, and damper head 2 is typically made of wood. Damper head 2 is supported by a rigid damper wire 3 attached at one end 3*a* to damper head 2 and at an opposite end 3b to a top flange 5 by a locking mechanism 4, e.g., a barrel and screw as shown in FIG. 1. Top flange 5 is mounted to an underlever 7 to rotate relative to underlever 7 about a pin 6. Underlever 7 is mounted to a mounting flange 8 to rotate relative to mounting flange 8 about a pin 31. Mounting flange 8 is attached to other structural elements, described below, by a flange screw 9.

FIG. 2 demonstrates how the prior art damper assembly of FIG. 1 operates to displace cushions 1 from piano string 30 when a piano key 10 is depressed. As shown in FIG. 2, a downward force 32 is applied at a proximal end 35 of piano key 10. Since piano key 10 rests on a fulcrum 33, this results in upward displacement of the opposite, distal end 37 of piano key 10 (arrow 39). Distal end 37 comes in contact with an underside 36 of underlever 7, and subsequently rotates underlever 7 about pin 31 (arrow 41), transmitting the upward displacement through top flange 5, damper wire 3 and damper head 2 (arrow 43), lifting cushions 1 off piano string 30. This allows an undamped vibration of piano string 30 when struck by a hammer (not shown). Associated movements of other components of the piano action, causing the hammer to strike piano string 30 and produce a tone, are not shown.

An important adjustment in the regulation of piano actions is the proper spacing 14 between the underside 36 of underlevers 7 and the distal end 37 of keys 10. This determines the distance the distal end of the key must travel before damper head 2 is displaced from string 30, and thus the amount of downward force 32 which must be applied to proximal end 35 of the piano key 10. In practice, the spacing is adjusted by the "feel" of a trained technician. According to the prior art, this adjustment is made by loosening locking mechanism 4 between top flange 5 and damper wire 3, rotating the underlever about pin 31 to provide the desired spacing 14, and then retightening locking mechanism 4. In a typical prior art grand piano, this adjustment must be repeated for the sixty damper assemblies present in the piano. Analogous adjustments are made for upright pianos as well.

Referring to FIG. 3, prior art damper assembly 100 typically includes a rail assembly 41 with a damper tray 11. Damper tray 11, designed to contact the underside 36 of each of a number of underlevers 7 in a group of underlevers, is typically operated by a foot pedal. This allows the vibrations of all piano strings associated with the group of underlevers to remain undamped as long as the foot pedal is operated. Rail assembly 41 includes a pair of stationary blocks 12 to which damper tray 11 is coupled by pivot pins 16 received in pivot cavities 17 defined by blocks 12 for rotation relative to blocks 12 about pins 16. Pivot blocks 12 are fixedly mounted to piano case 40 by mounting screws 19.

When damper tray 11 is rotated, for example, by actuating a mechanism (not shown) attached to a foot pedal (not shown), a pad 34 attached to tray 11 (typically made of felt or other material capable of absorbing noise) contacts the underside 36 of underlever 7, causing upward displacement of cushions 1 through the same mechanism as described above with respect to the piano key action. Rotation of damper tray 11 results in motion of underlever 7, even before contact between pad 34 and the underside 36 of underlever 7. This is true unless the axes of rotation of underlever 7 (through pin 31) and damper tray 11 (through pins 16) are coincident.

FIG. 4 depicts an alternate embodiment of a prior art damper assembly 100*a*. Damper assembly 100*a* includes an underlever 7*a* mounted to piano casing 40 by a rail assembly 41*a*, and a damper tray 13*a* independently mounted to the piano casing 40. Rail assembly 41*a* is mounted to piano casing 40 in a fixed position with screws 43*a*. Damper tray 13*a* includes a pad 34*a* for contacting the underside 36*a* of underlever 7*a*. Tray 13*a* is mounted to piano case 40 with mounting flanges 42*a* and screws 44*a*. Tray 13 pivots about pins 46*a*. Upward force on damper tray 13 causes pad 34 to contact the underside of underlever 7. Further movement of tray 13 causes upward displacement of cushions 1 in an equivalent way as described with respect to FIG. 3, but rotation of independent damper tray 13 does not, in and of itself, cause movement of underlever 7 until pad 34 contacts the underside of underlever 7. That is, the rotation of underlever 7 and damper tray 13 are not coupled until pad 34 contacts the underside 36 of underlever 7.

Referring to FIG. 5, a piano action of an upright piano, according to the prior art, includes a damper assembly 200. As in a grand piano, cushions 101 dampen vibrations of piano strings 130. Cushions 101 are mounted on a damper head 102 (typically made of wood), which is positioned adjacent to string 130 as shown. Damper head 103 is supported by a rigid damper wire, a lower end 105 of which is press-fit into an underlever 136. Underlever 136 is rotatably connected to a flange 137 by a pin 106. Flange 137 is mounted to a primary action rail 138.

In operation, piano key 110, resting on a fulcrum 133, is subjected to a downward force 132 at proximal end 134. This results in upward displacement (arrow 107) of the opposite, distal end 135 of piano key 110. Distal end 135 comes in contact with the underside of one end 141 of a wippen assembly 139, causing the latter to pivot about a pin 131. The opposite end 143 of wippen assembly 139, which has a spoon 140 mounted on its upper surface 145, is thereby rotated downward (arrow 146) and contacts underlever 136, producing rotation of underlever 136 about pin 106. This causes the upper end 149 of underlever 136 (and consequently damper wire 103, damper head 102 and cushion 101) to move away from piano string 130 (arrow 148), acting against the bias introduced by a wire spring 141. This allows piano string 130 to vibrate freely when it is struck by a hammer 151.

The spacing 114 between spoon 140 and underlever 136 is important in determining when, during the piano keystroke, cushion 101 is lifted off string 130. The greater the spacing 114, the later during a keystroke cushion 101 is displaced from string 130. This significantly affects the way the keys feel to a pianist, as described above. As with grand pianos, space 114 is individually adjusted for each damper assembly. For either type of piano, inconsistencies are introduced with such individual adjustments, and the individual adjustments are time-consuming and difficult to perform.

SUMMARY OF THE INVENTION

The invention results from the realization that significant advantages can follow from a damper assembly which allows adjustment of the timing of the underlevers (that is, the spacing between underlevers and piano keys) in a groupwise, rather than individual, fashion.

In one aspect, the invention features a damper assembly for a piano. The damper assembly includes a rail assembly with an adjustable mount for mounting the rail assembly to the piano case, and a plurality of underlevers coupled to the rail assembly.

Embodiments of this aspect of the invention may include one or more of the following features.

The underlevers are rotatably coupled to the rail assembly. The rail assembly is configured for vertical adjustment relative to the case, for example, continuous adjustment (in which the rail assembly can define a vertical slot) or discrete adjustment (in which the rail assembly defines discrete openings arranged vertically). The rail assembly has two ends, and the adjustable mount includes a slot in a region of one end and another slot in a region of the opposite end. The adjustable mount includes an adjustment screw in each slot.

In one illustrated embodiment, the rail assembly includes a rail and an attached damper tray. The rail is configured for mounting to the case for rotation relative to the case. The adjustable mount includes mounting blocks, and the rail is mounted to the blocks for rotation relative to the blocks. The mounting blocks each define an adjustment slot. In another illustrated embodiment, the damper assembly includes a damper tray mounted to the case independently of the rail assembly.

The damper assembly includes a plurality of damper wires. Each of the underlevers is coupled, for example, rotatably coupled, to a respective damper wire.

In other embodiments, the piano has a horizontal axis and the rail assembly is configured for horizontal adjustment relative to the case.

According to another aspect of the invention, a piano includes a case and a damper assembly. The damper assembly includes a rail assembly having an adjustable mount which mounts the rail assembly to the case, and a plurality of underlevers coupled to the rail assembly.

Embodiments of this aspect of the invention may include one or more of the following features.

The mount includes adjustable mounting blocks coupled to the rail assembly, and mounting screws for fixing the mounting blocks to the case. The mounting blocks define slots for receiving the mounting screws. The mount includes slots defined in the rail assembly and mounting screws received in the slots for fixing the rail assembly to the case.

According to another aspect of the invention, a method of simultaneously adjusting a plurality of piano underlevers in a piano includes mounting a damper assembly to a piano case with an adjustable mount, the damper assembly including a rail assembly and a plurality of underlevers coupled to the rail assembly, and adjusting the position of the rail assembly relative to the case.

Embodiments of this aspect of the invention may include one or more of the following features.

The method includes rotatably coupling the underlevers to the rail assembly. The piano has a vertical axis, and the step of adjusting the rail assembly position relative to the case includes vertically adjusting the rail assembly position. The step of adjusting the rail assembly position relative to the case includes adjusting a spacing between the underlevers and a corresponding group of piano keys. Alternatively, the step of adjusting the rail assembly position relative to the case includes horizontally adjusting the rail assembly position.

The invention provides a number of advantages over previously known damper adjustment devices and methods. The inventive damper adjustment device permits the adjustment of a group of underlevers, rather than the adjustment of individual underlevers which has previously been required. More specifically, the inventive damper adjustment device permits the adjustment of distances between underlevers and their corresponding elements for displacing damper heads from piano strings without loosening the locking mechanisms of individual damper assemblies. Individual artists prefer the same "feel" for all the keys. Thus, the invention advantageously minimizes the introduction of string-to-string inconsistencies between the damper assemblies. The inventive damper adjustment device allows factory-established settings to be maintained for long periods of time. Further, the time and skill required to regulate damper settings are reduced.

Other features and advantages of the invention will be apparent from the following detailed description, and from the claims.

DESCRIPTION OF THE PREFERRED EMBODIMENTS

The invention results from the realization that adjustments of the timing of piano underlevers can be made quickly, reliably and easily if the timing can be adjusted groupwise, and simultaneously. To accomplish this goal, a damper assembly for adjusting underlevers in a groupwise fashion has been devised. The damper assembly can be utilized in grand pianos and upright pianos.

Figure 6:
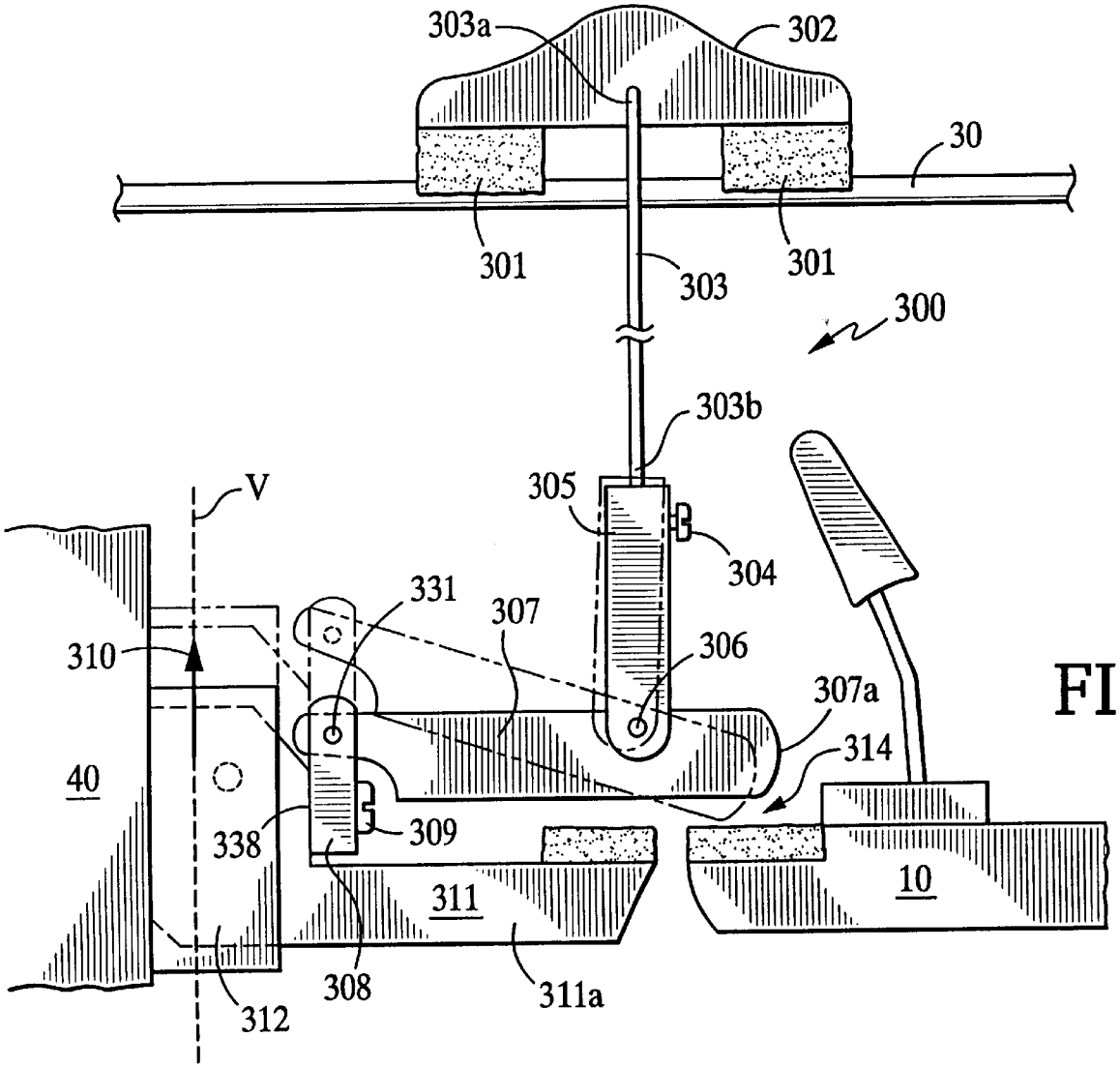
FIG. 6 is a side view of a grand piano key and damper assembly according to a particular embodiment of the invention.
Figure 7:
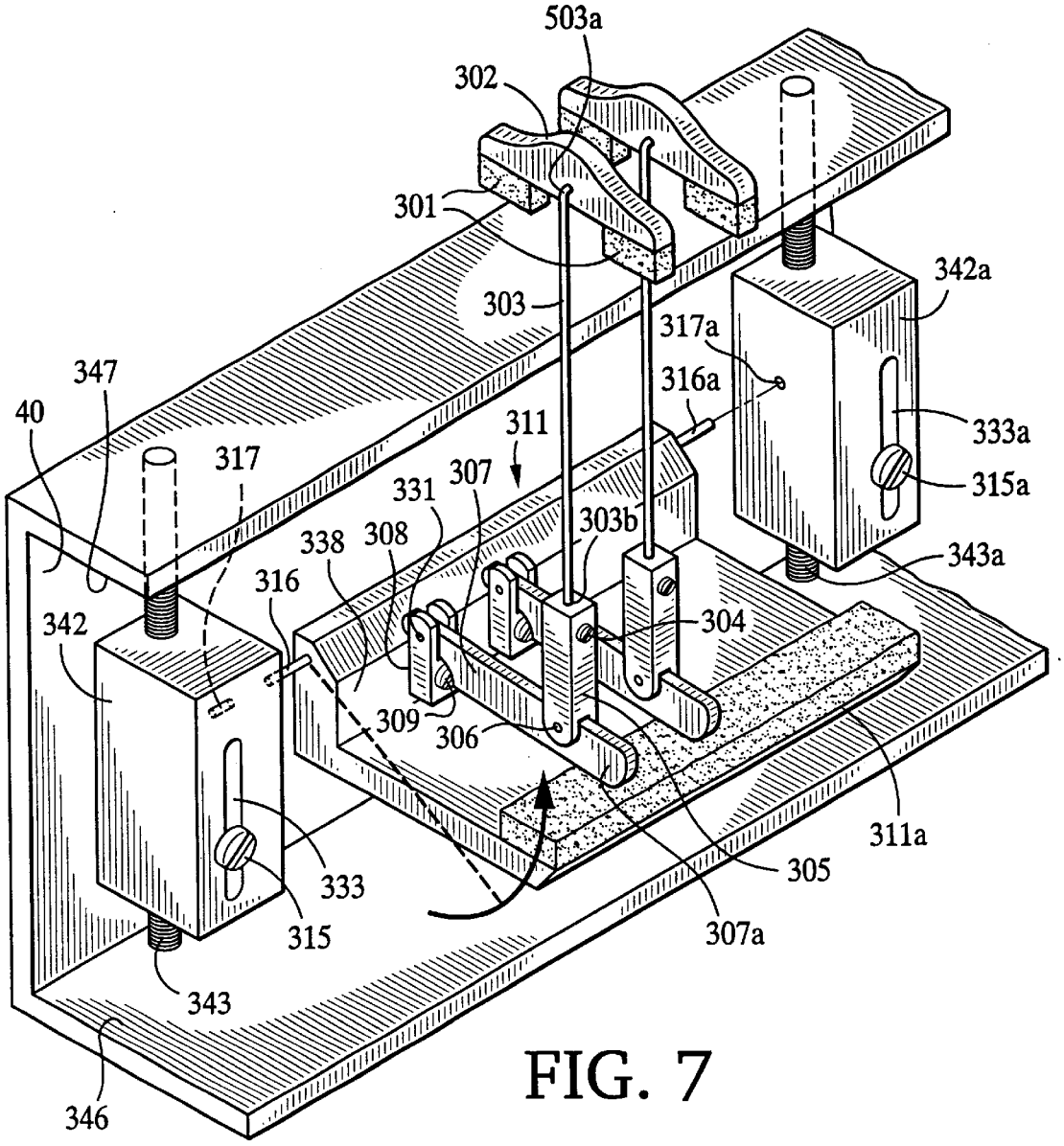
FIG. 7 is a perspective view of the damper assembly of FIG. 6.

Referring to FIGS. 6 and 7, a damper assembly 300 includes a rail assembly 311 adjustably mounted to a piano case 40. Rail assembly 311 includes a damper tray 311*a* and a mount 312 for adjusting the position of rail assembly 311 relative to case 40. Damper assembly 300 includes a plurality of underlevers 307 coupled to damper tray 311*a* (only two underlevers 307 being shown in FIG. 7). Adjustment of rail assembly 311 affects the size of a gap 314 (FIG. 6) between all underlevers 307 and their respective piano keys 10, or a group of underlevers 307 and their respective piano keys 10. The size of gap 314 is adjusted to change the "feel" of the piano keys. A smaller gap means that the dampers lift earlier in the keystroke, and a larger gap means that the dampers lift later in the keystroke. Personal preferences can dictate the exact timing desired.

Damper assembly 300 includes cushions 301 mounted on a damper head 302. Damper head 302 is supported by a rigid damper wire 303 attached at one end 303*a* to damper head 302 and at an opposite end 303*b* to a top flange 305 by a locking mechanism 304. Top flange 305 is mounted to an underlever 307 to rotate relative to underlever 307 about a pin 306. Underlever 307 is mounted to a mounting flange 308 to rotate relative to mounting flange 308 about a pin 331. Mounting flange 308 is attached to a back wall 338 of damper tray 311 a by a flange screw 309.

Referring particularly to FIG. 6, adjustment of the vertical position of rail assembly 311 along vertical axis, V, e.g., raising rail assembly 311 (arrow 310), raises flange 308. Under the weight of underlever 307, this causes underlever 307 to rotate about pin 331 and top flange 305 to rotate about pin 306 such that cushions 301 remain in contact with string 30 and end 307*a* of underlever 307 lowers (as shown in dashed lined), thus changing the size of gap 314.

Referring particularly to FIG. 7, rail assembly 311 includes mounting blocks 342, 342*a* for mounting damper tray 311*a* to piano case 40. Damper tray 311*a* is coupled to blocks 342, 342*a* to pivot relative thereto by pivot pins 316, 316*a* received in cavities 317, 317*a* defined by pivot blocks 342, 342*a,* respectively. Blocks 342, 342*a* define slots 333, 333*a,* respectively, which permit vertical adjustment of damper tray 311*a*. Each block 342, 342*a* is mounted to case 40 by a screw 315, 315*a,* respectively, and is supported on an adjustment bolt 343, 343*a,* respectively.

Figure 8A:
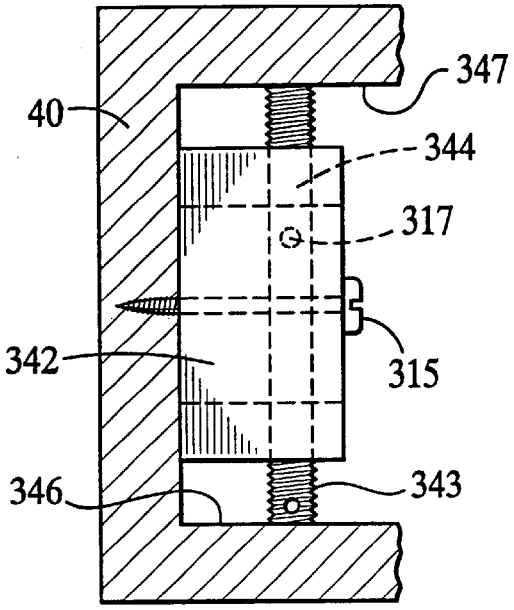
FIGS. 8A and 8B are a side and front view, respectively, of a slotted grand piano damper tray pivot block.
Figure 8B:
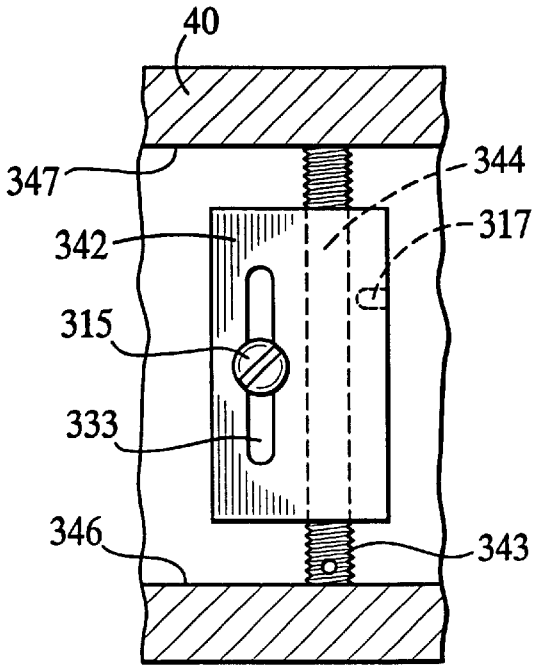

Adjustment bolts 343, 343*a* contact piano case 40 along a bottom horizontal surface 346 and an overhanging horizontal surface 347 of case 40. Alternatively, rather than including surfaces 346, 347 along the full length of case 40, a "C"-shaped bracket, not shown, can be introduced only directly above and below the location of blocks 342, 342*a*. FIGS. 8A and 8B further depict slotted rail pivot block 342, as having a threaded passageway 344 which receives adjustment bolt 343.

Figure 1:
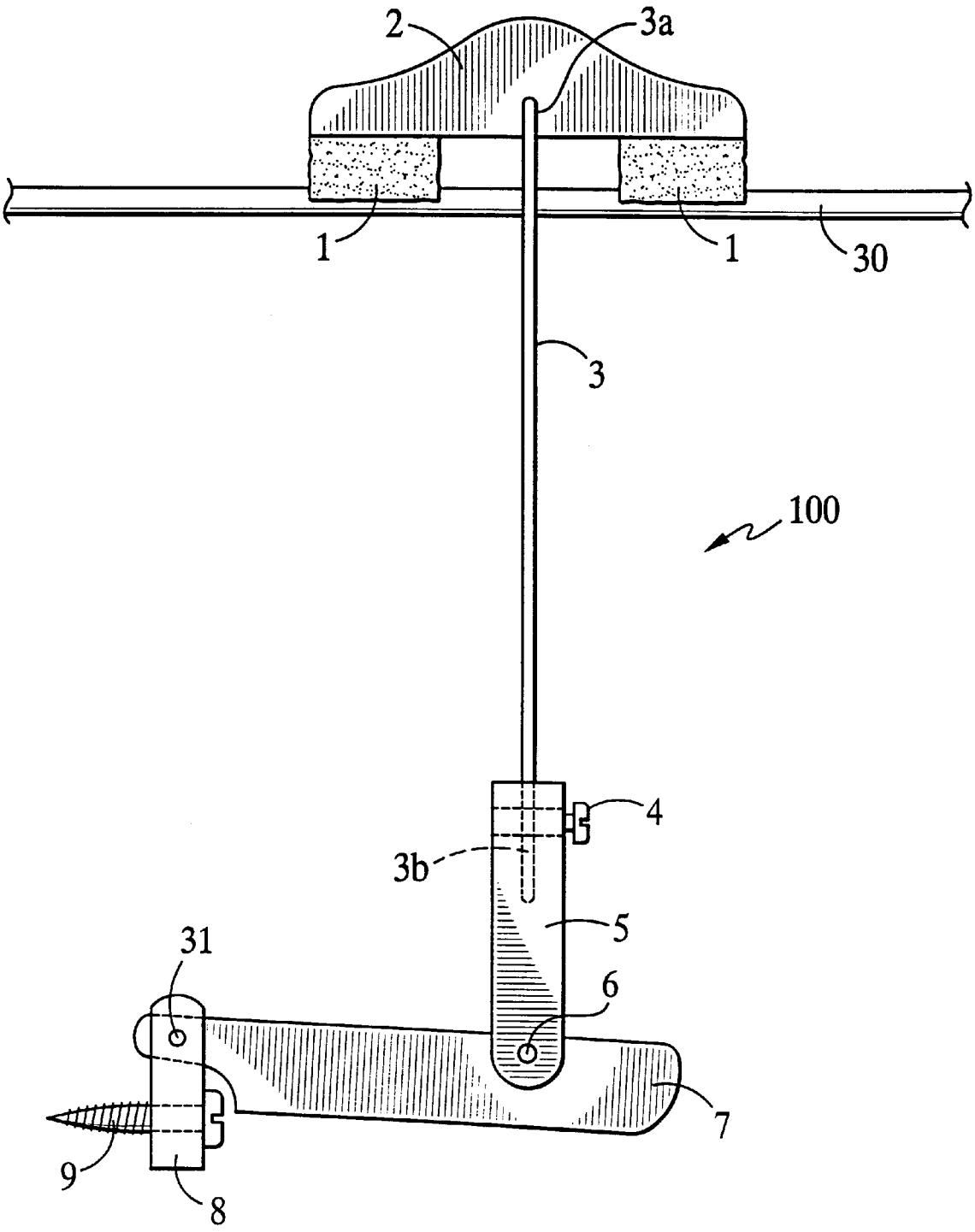
FIG. 1 (Prior Art)
FIG. 1 is a side view of a prior art grand piano damper assembly.
Figure 2:
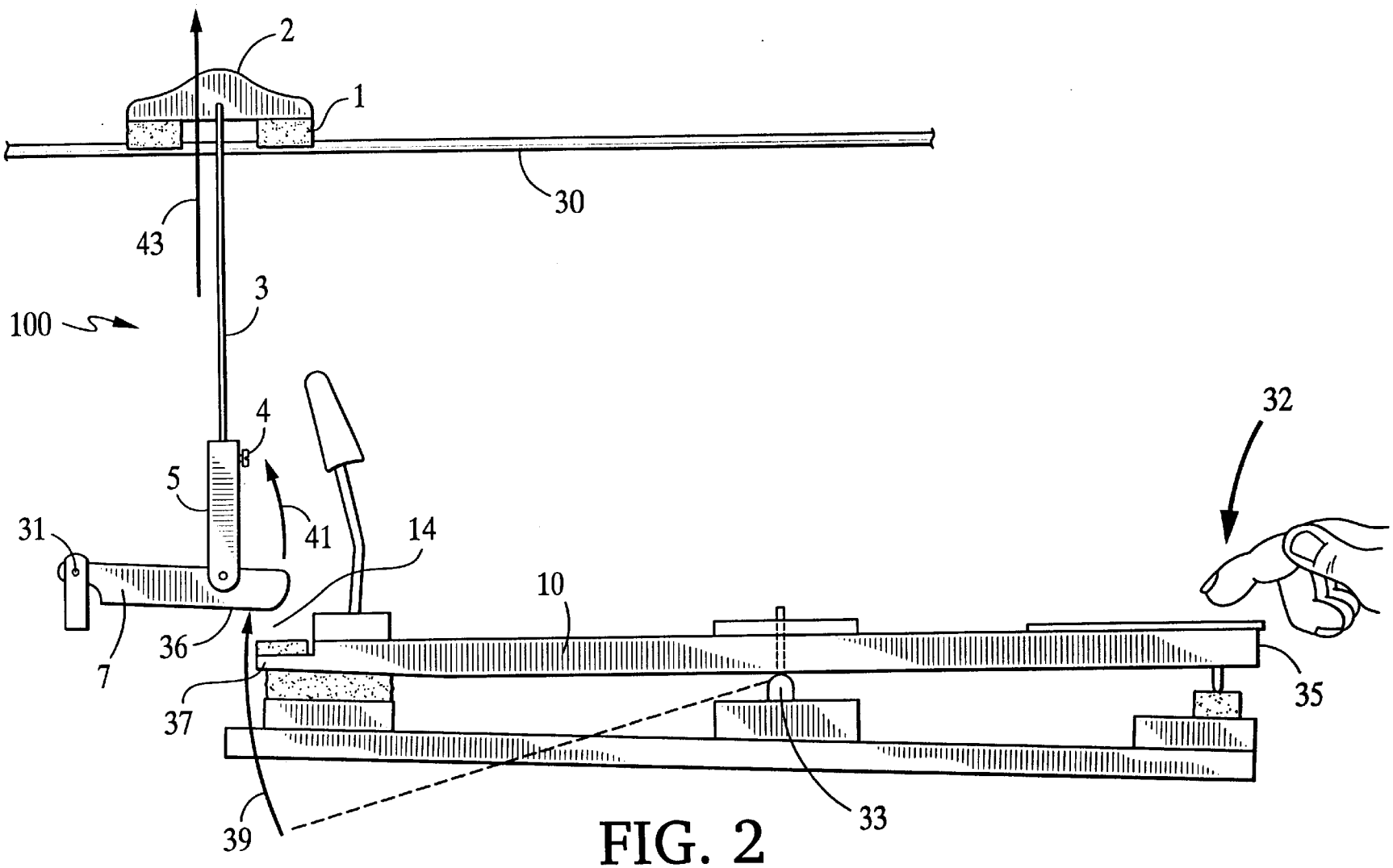
FIG. 2 (Prior Art)
FIG. 2 is a side view of a prior art grand piano key and damper assembly.
Figure 3:
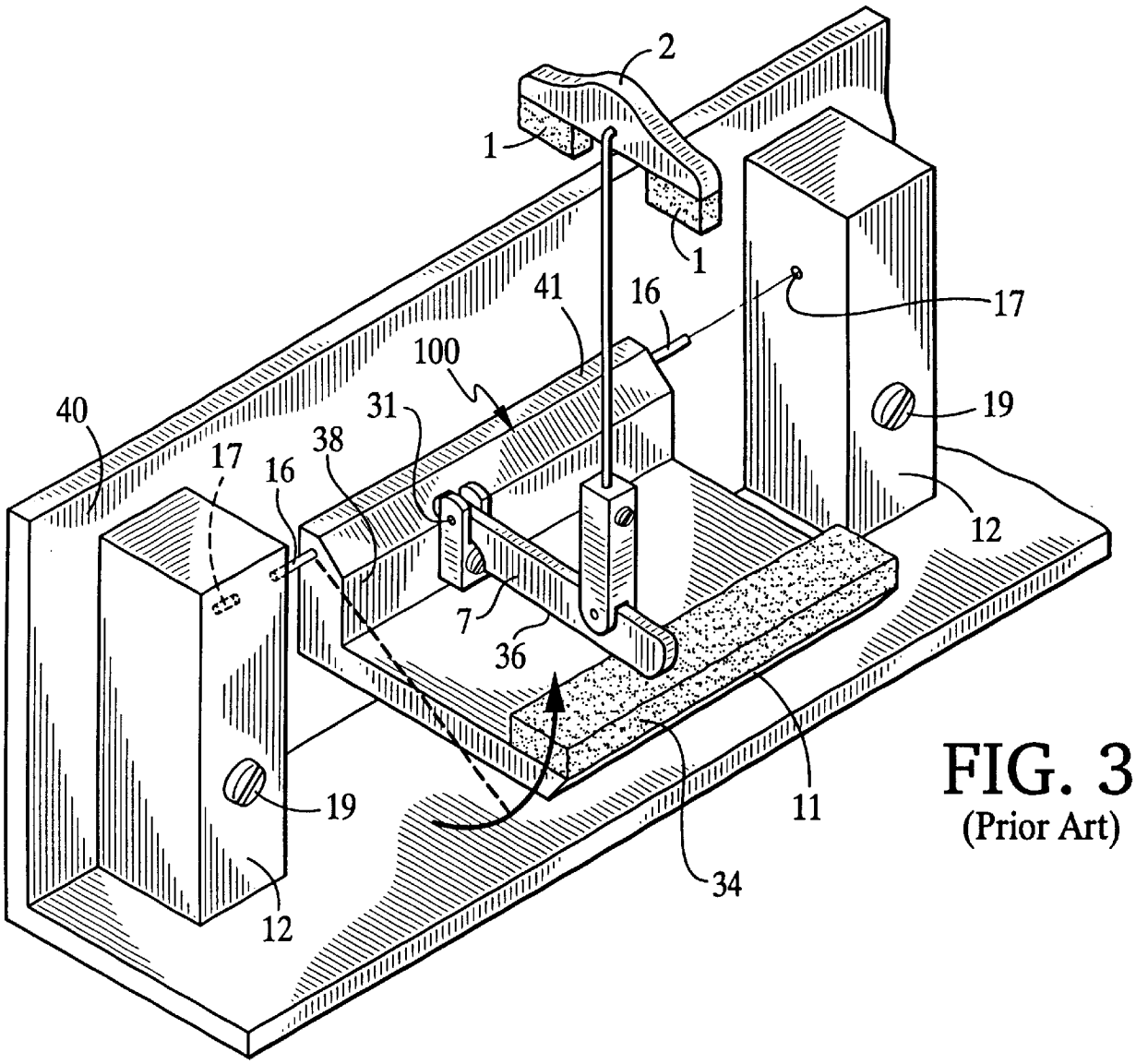
FIG. 3 (Prior Art)
FIG. 3 is a perspective view of a prior art grand piano damper assembly and damper tray.
Figure 4:
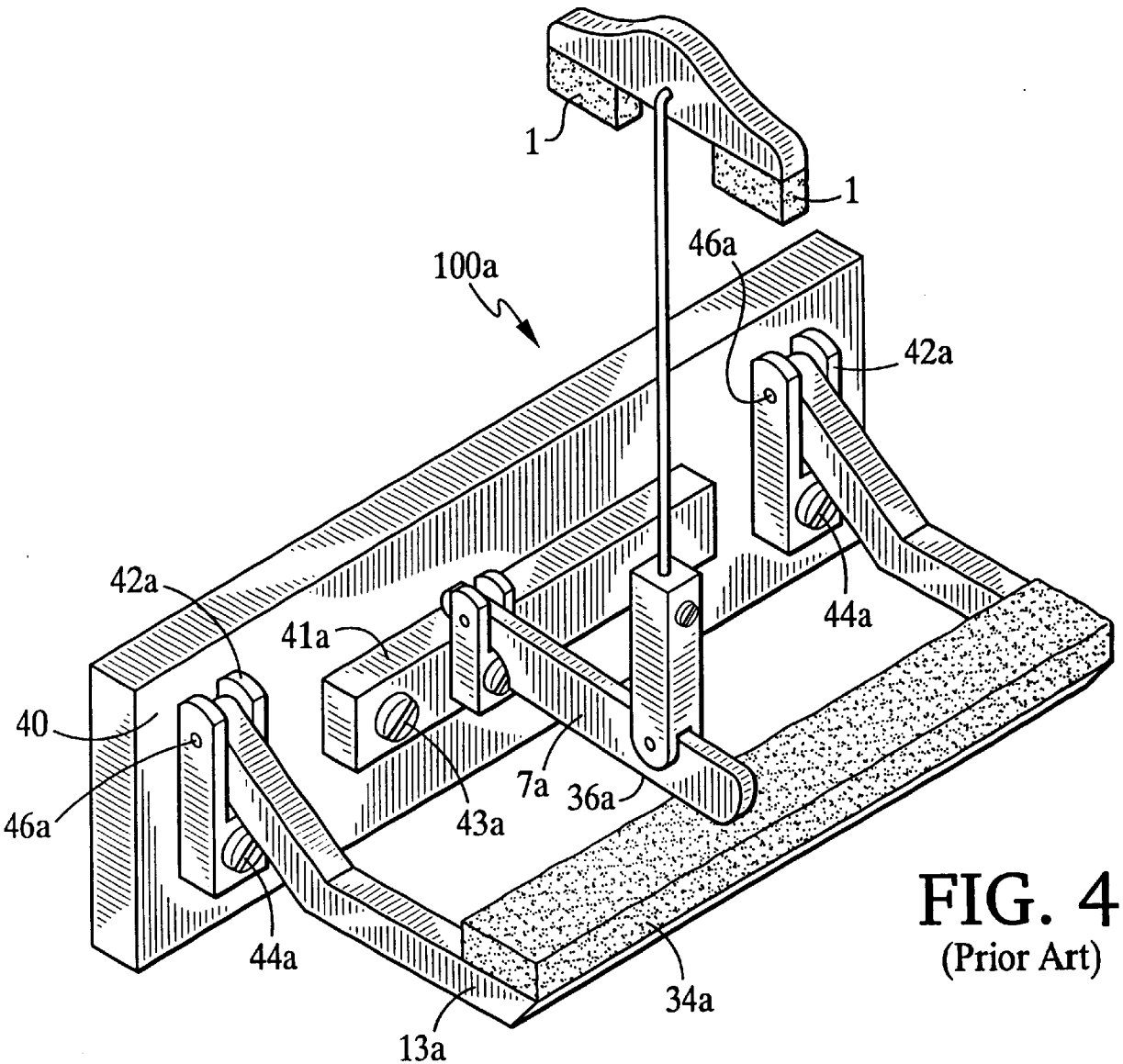
FIG. 4 (Prior Art)
FIG. 4 is a perspective view of an additional prior art grand piano damper assembly and damper tray.
Figure 9A:
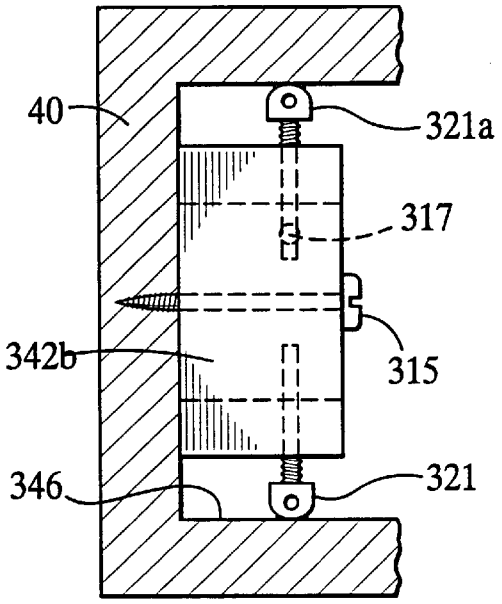
FIGS. 9A and 9B are a side and front view, respectively, of an alternative embodiment of a slotted grand piano damper tray pivot block.
Figure 9B:
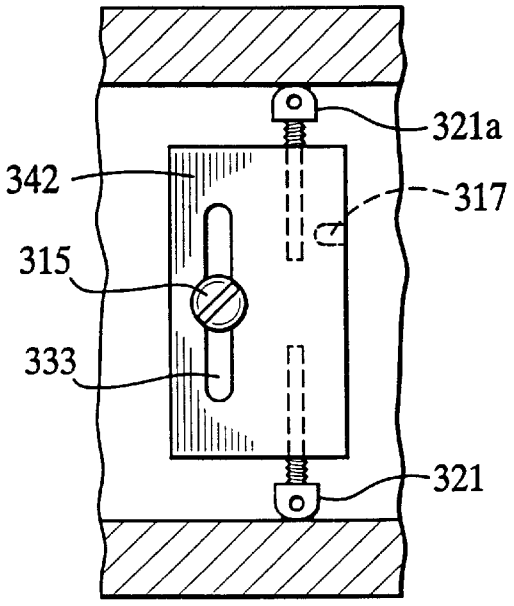

Blocks 342, 342*a* are adjusted by loosening screws 315, 315*a,* turning adjustment bolts 343, 343*a* until blocks 342, 342*a* are adjusted to a desired position, and tightening screws 315, 315*a*. Adjustment bolts 343, 343*a* can be turned by any of a number of ways known to those of skill in the art including the use of an adjustment pin (not shown) passing through the diameter of the bolt, or the use of a hexagonal nut (not shown) mounted to the bolt. Alternatively, as shown in FIGS. 9A and 9B, an adjustment block 342*b* can include two adjustment bolts 321, 321*a*. FIGS. 8A and 9A show alignment of pivot hole (317 or 317*a*) with adjustment devices thus minimizing block rotation. While adjustment blocks 342, 342*a* permit groups of underlevers or all underlevers in the piano to be adjusted simultaneously, individual adjustment is still possible using locking mechanism 304, as described above with reference to FIG. 1.

Figure 10A:
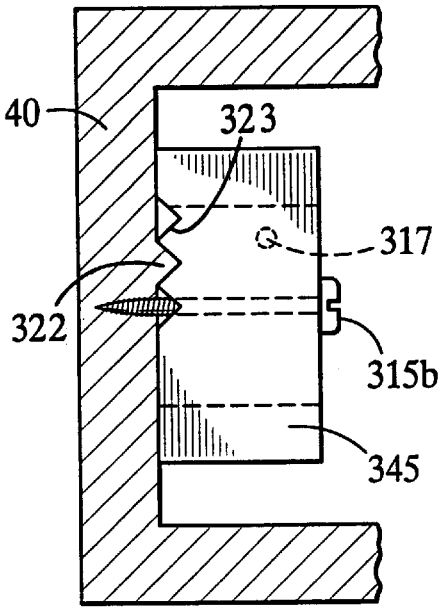
FIGS. 10A and 10B are a side and front view, respectively, of an additional alternative embodiment of a slotted grand piano damper tray pivot block.
Figure 10B:
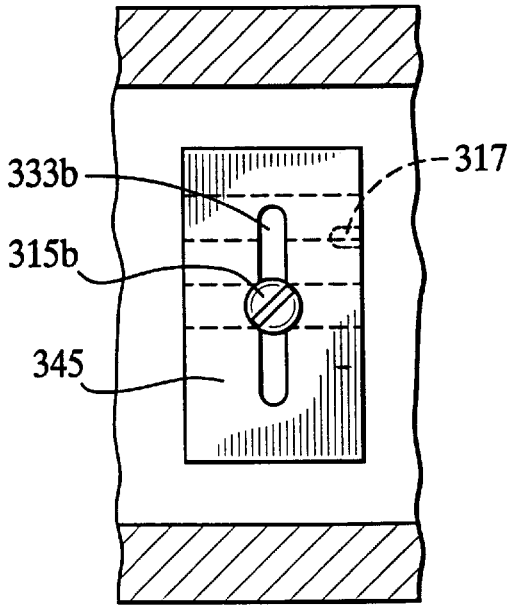

FIGS. 10–12 depict embodiments of the invention which provide discrete adjustment of damper tray 311*a* rather than the continuous adjustment provided by blocks 342. Referring to FIGS. 10A and 10B, mounting block 345 includes three notches 323, one of which receives a corresponding protrusion 323 on case 40. Alternatively, block 345 can include protrusions and case 40 corresponding notches. Block 345 defines a slot 333*b* and is mounted to case 40 with a screw 315*b*. To adjust the vertical position of block 345, screw 315*b* is loosened, block 345 is moved to the new desired position with protrusion 323 located in one of notches 323, and screw 315*b* is tightened. Although FIG. 10A discloses three triangular shaped notches, other shapes and number of notches can be utilized.

Figure 11A:
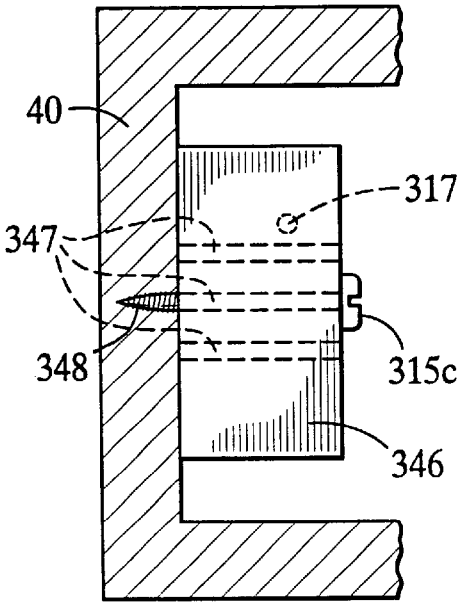
FIGS. 11A and 11B are a side and front view, respectively, of an alternative embodiment of a grand piano damper tray pivot block.
Figure 11B:
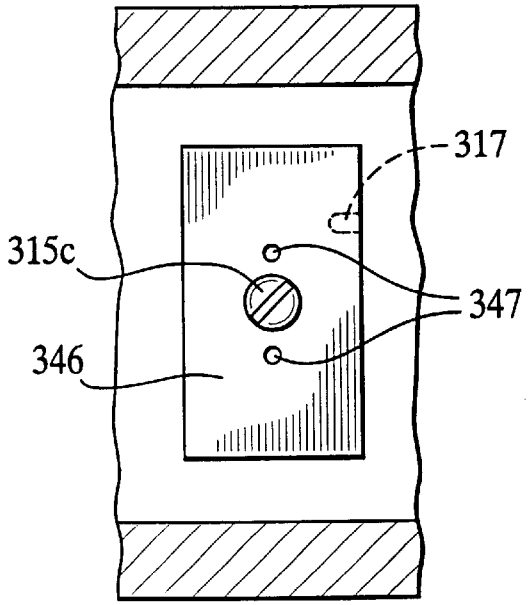
Figure 12A:
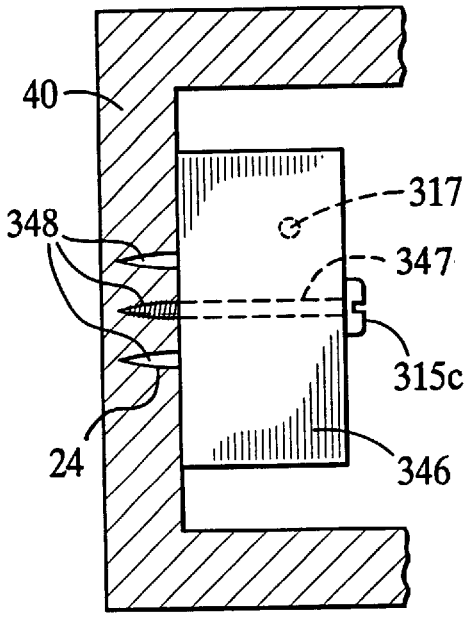
FIGS. 12A and 12B are a side and front view, respectively, of an additional alternative embodiment of a grand piano damper tray pivot block.
Figure 12B:
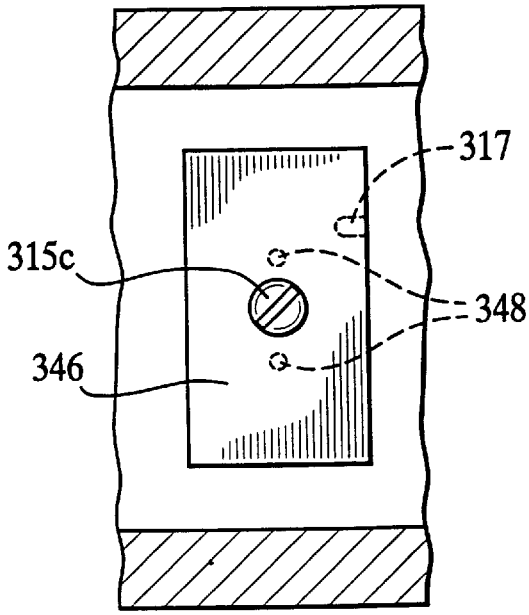

Referring to FIGS. 11A and 11B, a mounting block 346 defines three vertically oriented screw holes 347 for receiving a screw 315*c*. Piano case 40 defines a single screw cavity 348 for receiving screw 315*c*. To adjust the vertical position of block 346, screw 315*c* is removed from block 346, block 346 is moved to align a new screw hole 346 with hole 348, and screw 315*c* is placed through the new screw hole 346 into hole 348. Alternatively, as shown in FIGS. 12A and 12B, piano case 40 defines a number of pivot block screw cavities 348, and rail block 346 defines a single screw hole 347.

Figure 13:
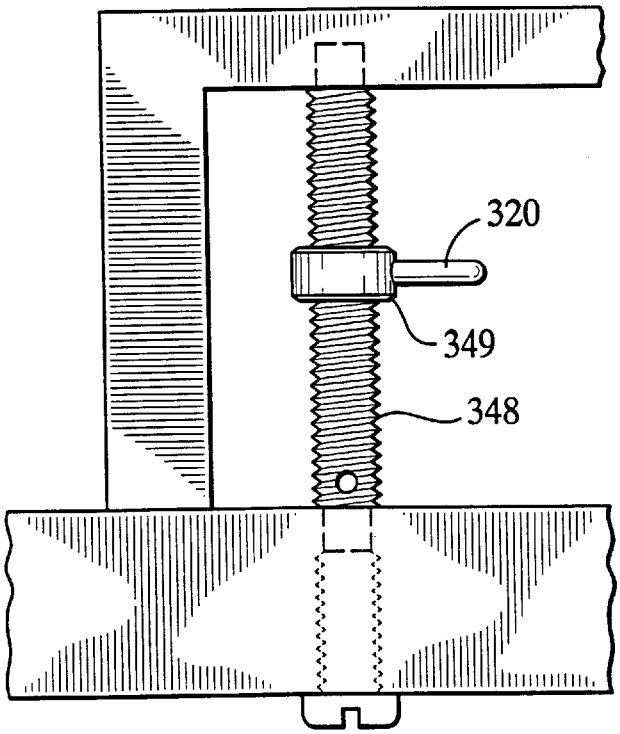
FIG. 13 is a side view of an adjustment bolt for a grand piano damper tray pivot assembly.

Referring to FIG. 13, an additional continuous adjustment mechanism includes a bolt 348 mounted to case 40 to rotate relative to case 40 while not undergoing axial translation. Threaded onto bolt 348 is a nut 349. With nut 349 prevented from rotating, rotation of bolt 348 changes the axial position of nut 349. Nut 349 can be coupled to a rail pivot block to vertically adjust the position of the rail pivot block, substantially as described above. For example, a pin 320 associated with nut 349 can be inserted into a corresponding cavity in the rail pivot block.

Figure 5:
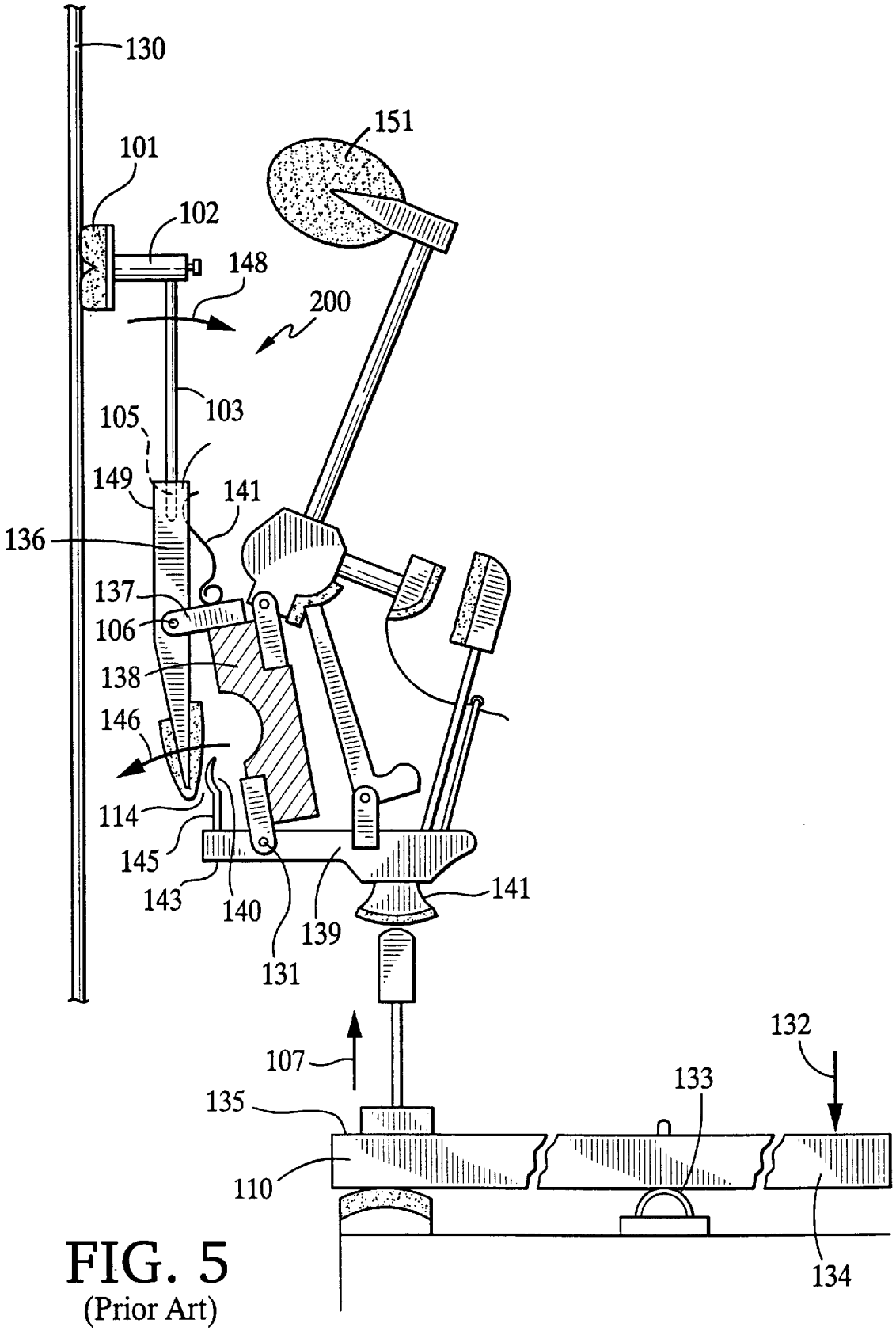
FIG. 5 (Prior Art)
FIG. 5 is a side view of a conventional prior art upright piano action.
Figure 14:
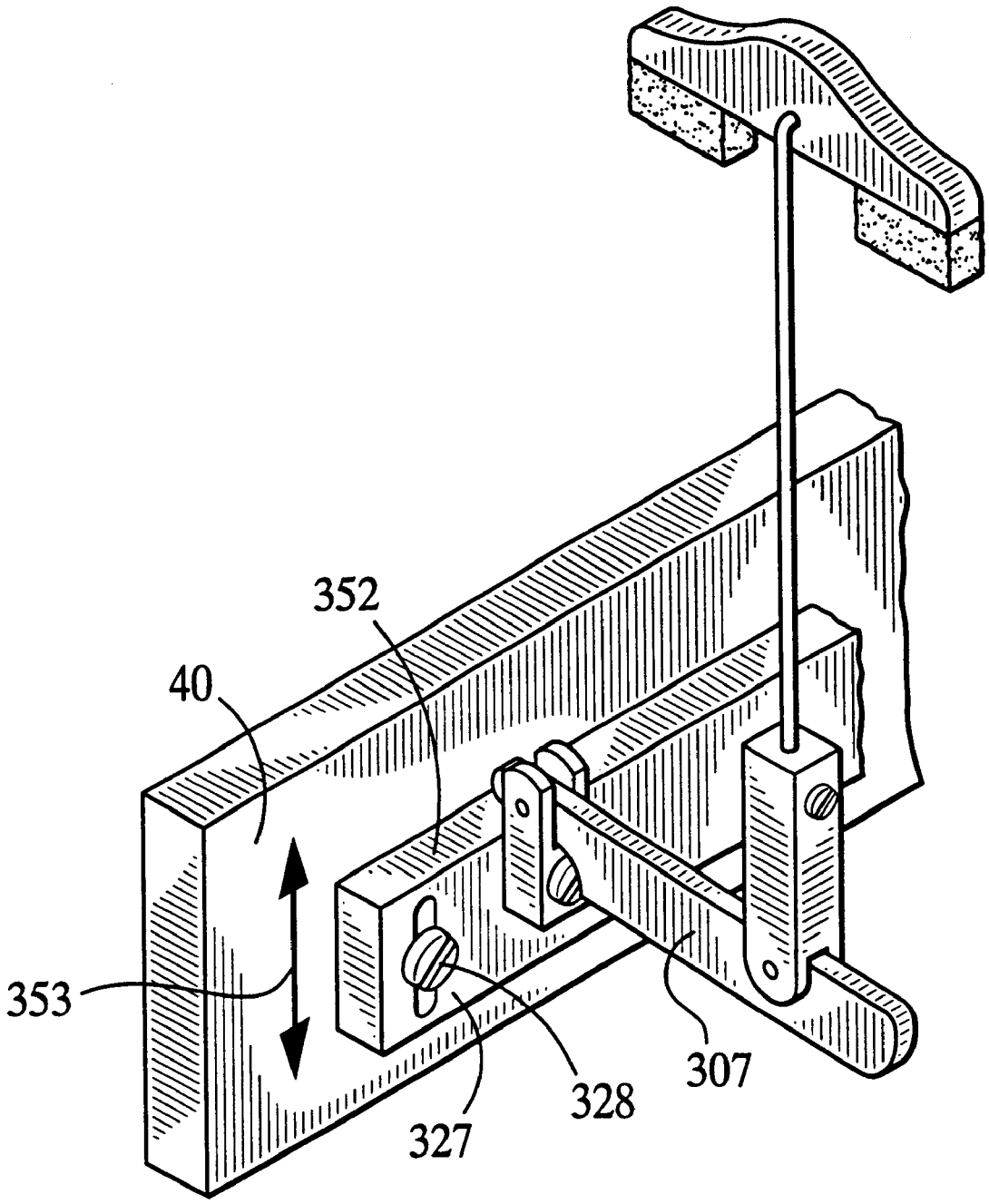
FIG. 14 is a perspective view of an additional embodiment of a grand piano damper assembly.

FIG. 14 shows an embodiment of the invention in which underlever 307 is coupled to a rail assembly 352 adjustably mounted to case 40. Rail 352 defines a vertical slot 327 for receiving a screw 328 for mounting rail 352 to piano case 40. There are generally at least two such slots 327 and screws 328, typically one at each end, although embodiments can be envisioned having a single slot/screw combination, or more than two. The vertical position of rail 352 can be adjusted (arrow 353) by loosening screw 328 and sliding rail 352 to a new position. A separate damper tray (not shown) interacts with underlevers 307 as described above with reference to FIG. 5. In this embodiment, the motions of the damper tray and rail 352 are decoupled.

Figure 15:
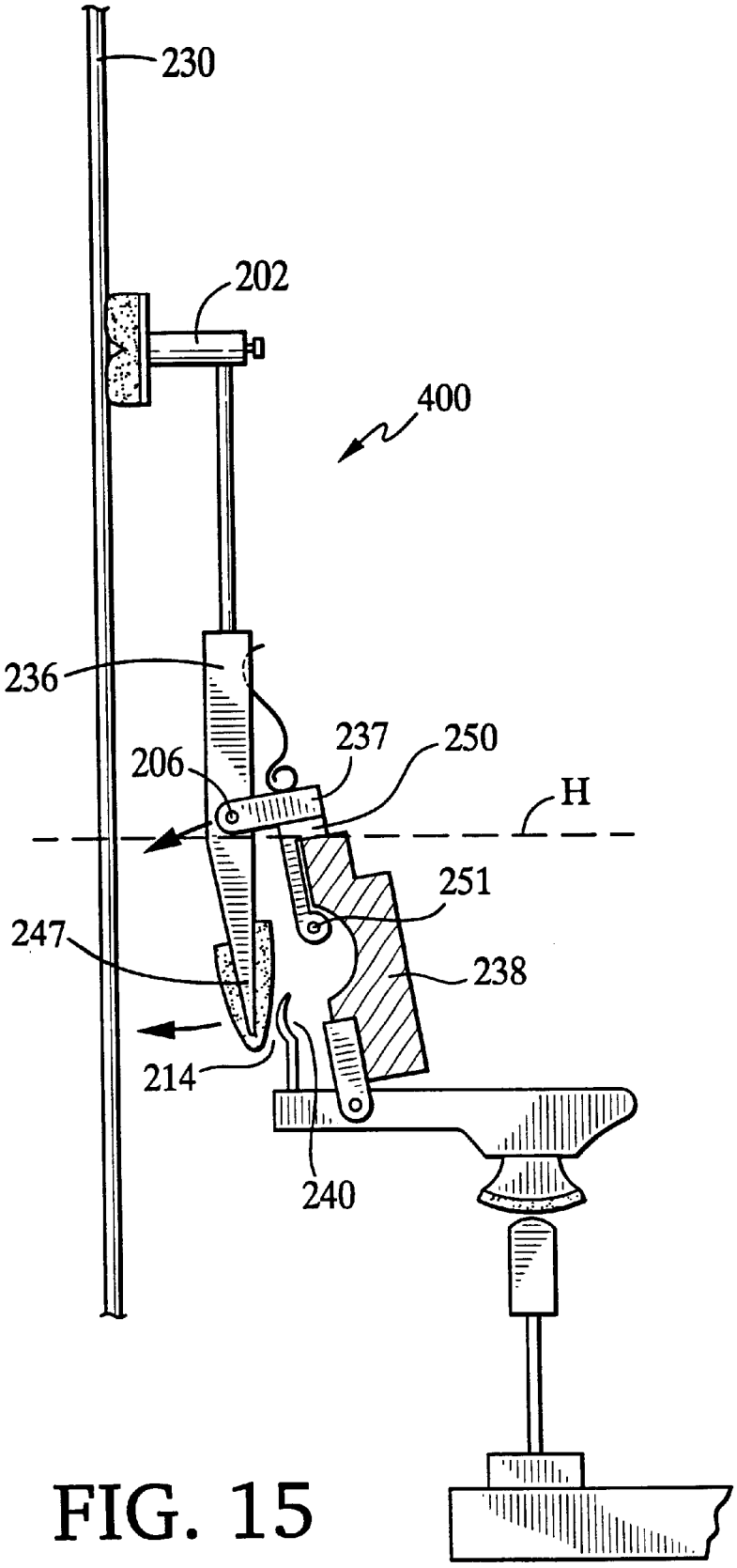
FIG. 15 is a side view of an upright piano damper assembly according to a particular embodiment of the invention.

The invention is also well suited for use in an upright piano, as described below. Referring to FIG. 15, an underlever 236 is rotatably attached to a flange 237 by a pin 206. Flange 237 is mounted to an auxiliary rail 250, which is rotatably adjustable about a pin 251 to change the horizontal position of flange 237, generally along a horizontal axis, H. As described below, auxiliary rail 250 can be either rotatably adjustable or translationally adjustable with respect to primary action rail 238. Auxiliary rail 250 extends across the damper assemblies of several keys in an upright piano, and, preferably, across the width of all damper assemblies in an upright piano. Horizontal adjustment of flange 237 relative to primary action rail 238, for example, toward piano string 230, causes the lower end 247 of underlever 236 to be moved away from spoon 240, thereby increasing the space 214 between this end of underlever 236 and spoon 240. This increased space results in later damper head displacement during a keystroke. Conversely, moving flange 237 away from string 230 results in damper head 202 being displaced from string 230 earlier in the keystroke.

Figure 16:
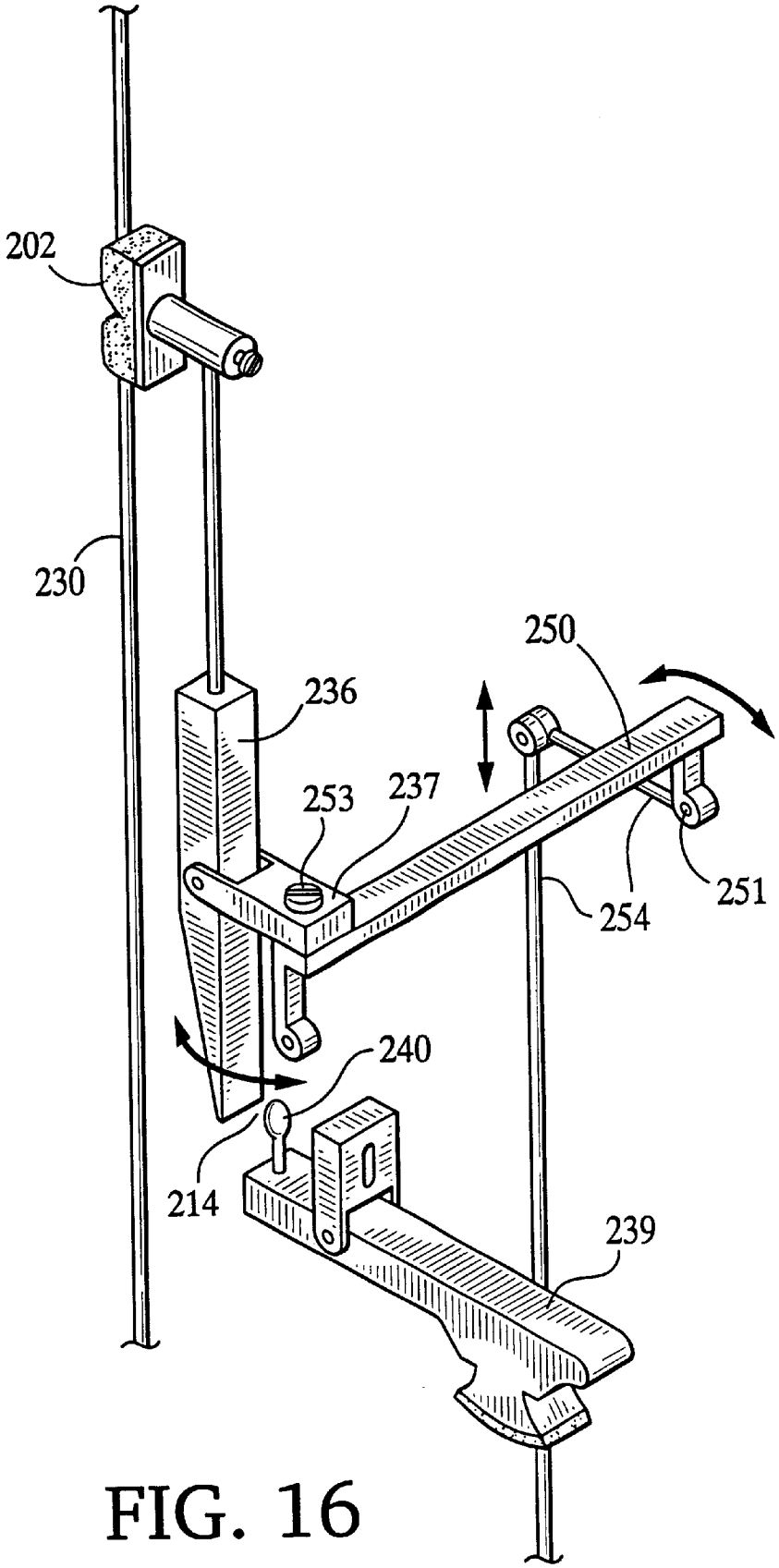
FIG. 16 is a perspective view of the upright piano damper assembly of FIG. 15.

Referring to FIG. 16, rotation or translation of rail 250 can be accomplished by attaching flange 237 to rail 250 with a screw 253. Flange 237 can include a slotted screw hole, adjustment bolts, notches, or any equivalent way of achieving either continuous or discrete positional adjustment of flange 237 relative to rail 250, as described above. Alternatively, rail 250 can pivot about pin 251 with the adjustment of the sweep angle being made, for example, using an adjustable screw which is placed in the position of pin 251, or by adjustment of a connecting rod 254, which lead to a foot pedal, lever, or other adjustment actuator.

It will be understood that "vertical" adjustment of the position of the rail is not limited to strictly straight-line, vertical adjustment, but also includes adjustment along a vertical arc, particularly an arc having its center at the point of rotation of underlever 307 about pin 306. Such vertical adjustment can eliminate any small lateral displacement of top flange 305 which is evident in FIG. 7 (shown by dotted line). This generality of adjustment applies equally for any particular embodiment calling for horizontal adjustment.

It is to be understood that while the invention has been described in conjunction with the detailed description thereof, the forgoing description is intended to illustrate and not limit the scope of the invention, which is defined by the scope of the appended claims. Other embodiments, aspects, advantages, and modifications are within the scope of the following claims.

What is claimed is:

1. A damper assembly for a piano, the piano including a case, said damper assembly comprising:

a rail assembly including an adjustable mount for mounting said rail assembly to the case, and a plurality of underlevers coupled to said rail assembly.

2. The damper assembly of claim 1, wherein said underlevers are rotatably coupled to said rail assembly.

3. The damper assembly of claim 1, wherein the piano has a vertical axis and said rail assembly is configured for vertical adjustment relative to said case.

4. The damper assembly of claim 3, wherein said rail assembly is configured for continuous vertical adjustment relative to said case.

5. The damper assembly of claim 4, wherein said rail assembly defines a vertical slot.

6. The damper assembly of claim 3, wherein said rail assembly is configured for discrete vertical adjustment.

7. The damper assembly of claim 6, wherein said rail assembly defines discrete openings arranged vertically.

8. The damper assembly of claim 1, wherein said rail assembly has a first end and a second end, said adjustable mount comprising a first slot defined in a region of said first end and a second slot defined in a region of said second end.

9. The damper assembly of claim 8, further comprising a first adjustment screw received by said first slot and a second adjustment screw received by said second slot.

10. The damper assembly of claim 1, wherein said rail assembly comprises a rail and attached damper tray.

11. The damper assembly of claim 10, wherein said rail is configured for mounting to the case for rotation relative to the case.

12. The damper assembly of claim 10, wherein said adjustable mount comprises two mounting blocks, said rail being mounted to said mounting blocks for rotation relative to said mounting blocks.

13. The damper assembly of claim 12, wherein said two mounting blocks each defines an adjustment slot.

14. The damper assembly of claim 1, wherein said damper assembly further comprises a damper tray mounted to said case independent of said rail assembly.

15. The damper assembly of claim 1, further comprising a plurality of damper wires, each of said plurality of underlevers being coupled to a respective one of said plurality of damper wires.

16. The damper assembly of claim 15, wherein each of said plurality of underlevers is rotatably coupled to said respective damper wire.

17. The damper assembly of claim 1, wherein the piano has a horizontal axis and said rail assembly is configured for horizontal adjustment relative to said case.

18. A piano, comprising:

a case, and a damper assembly including a rail assembly having an adjustable mount mounting said rail assembly to the case, and a plurality of underlevers coupled to said rail assembly.

19. The piano of claim 18, wherein said mount comprises adjustable mounting blocks coupled to said rail assembly, and mounting screws for fixing said mounting blocks to said case, wherein said mounting blocks define slots for receiving said mounting screws.

20. The piano of claim 18, wherein said mount comprises slots defined in said rail assembly and mounting screws received in said slots for fixing said rail assembly to said case.

21. A method of simultaneously adjusting a plurality of piano underlevers, comprising:

mounting a damper assembly to a piano case with an adjustable mount, the damper assembly including a rail assembly and a plurality of underlevers coupled to said rail assembly, and adjusting a position of said rail assembly relative to the case.

22. The method of claim 21, further comprising rotatably coupling said underlevers to said rail assembly.

23. The method of claim 21, wherein said piano has a vertical axis, and the step of adjusting the position of said rail assembly relative to said case comprises vertically adjusting the position of said rail assembly.

24. The method of claim 21, wherein the step of adjusting the position of said rail assembly relative to said case adjusts a spacing between said underlevers and a corresponding group of piano keys.

25. The method of claim 21, wherein the piano has a horizontal axis, and the step of adjusting the position of said rail assembly relative to said case comprises horizontally adjusting the position of said rail assembly.

* * * * *